US009022381B2

(12) United States Patent
Kase et al.

(10) Patent No.: US 9,022,381 B2
(45) Date of Patent: May 5, 2015

(54) SHEET FEEDING DEVICE AND IMAGE FORMING APPARATUS

(71) Applicant: Canon Kabushiki Kaisha, Tokyo (JP)

(72) Inventors: Shota Kase, Kawasaki (JP); Minoru Kawanishi, Yokohama (JP); Hirotaka Ishii, Suntou-gun (JP); Keisuke Fujita, Sagamihara (JP); Akinori Yokota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/149,069

(22) Filed: Jan. 7, 2014

(65) Prior Publication Data

US 2014/0197592 A1 Jul. 17, 2014

(30) Foreign Application Priority Data

Jan. 11, 2013 (JP) ..... 2013-003897

(51) Int. Cl.

| | |
|---|---|
| ***B65H 3/52*** | (2006.01) |
| ***B65H 1/12*** | (2006.01) |
| ***B65H 3/02*** | (2006.01) |
| ***B65H 3/06*** | (2006.01) |

(52) U.S. Cl.

CPC ..... *B65H 1/12* (2013.01); *B65H 3/5207* (2013.01); *B65H 3/02* (2013.01); *B65H 3/0607* (2013.01); *B65H 3/5223* (2013.01); *B65H 2402/543* (2013.01); *B65H 2403/512* (2013.01); *B65H 2403/60* (2013.01); *B65H 2404/1113* (2013.01)

(58) Field of Classification Search

CPC ..... B65H 3/02; B65H 3/46; B65H 3/52; B65H 3/5207

USPC ..... 271/121, 124, 104, 137, 138

See application file for complete search history.

(56) References Cited

U.S. PATENT DOCUMENTS

| | | | | |
|---|---|---|---|---|
| 4,089,516 | A * | 5/1978 | Colglazier et al. | 271/9.05 |
| 4,113,245 | A * | 9/1978 | Colglazier et al. | 271/10.11 |
| 5,370,381 | A * | 12/1994 | Winship et al. | 271/121 |
| 7,441,766 | B2 * | 10/2008 | Seki et al. | 271/121 |
| 8,695,964 | B2 * | 4/2014 | Hamaguchi et al. | 271/121 |
| 2005/0067758 | A1 * | 3/2005 | Seki et al. | 271/121 |

FOREIGN PATENT DOCUMENTS

| | | | |
|---|---|---|---|
| JP | 2533566 | B2 | 9/1996 |
| JP | 2001019196 | A | 1/2001 |

* cited by examiner

*Primary Examiner* — David H Bollinger

(74) *Attorney, Agent, or Firm* — Canon U.S.A., Inc. IP Division

(57) ABSTRACT

An image forming apparatus includes a sheet feeding device having a separation pad holding unit, a separation pad fixing unit, and a compression unit while vibration damping unit (such as a sponge member and a Mylar member) that is attached to the compression unit does not contact the separation pad holding unit and the separation pad fixing unit.

18 Claims, 9 Drawing Sheets

BLACK ARROW: MOVING DIRECTION OF COMPRESSION COIL SPRING 10

WHITE ARROW: DIRECTION OF AIR RESISTANCE ON SPONGE MEMBER 14

BLACK ARROW: MOVING DIRECTION OF COMPRESSION COIL SPRING 10

WHITE ARROW: DIRECTION OF AIR RESISTANCE ON MYLAR MEMBER 15

ARROW: DIRECTION OF SEPARATION PRESSURE

SHEET FEEDING DEVICE AND IMAGE FORMING APPARATUS

BACKGROUND OF THE INVENTION

1. Field of the Invention

The present invention relates to a sheet feeding device for feeding a sheet and an image forming apparatus including the sheet feeding device.

2. Description of the Related Art

Conventionally, an image forming apparatus, such as a copying machine or a printer, includes a sheet feeding device, which feeds a sheet stacked on a feeding tray to an image forming unit. Such a sheet feeding device includes a feeding unit, which feeds the sheet stacked on the feeding tray, and a separation unit, which separates one sheet from other sheets.

A separation pad is sometimes used as the separation unit so that one sheet is separated from other sheets by frictional force.

According to the separation method using the above-described separation pad, where frictional force between a feeding roller and the sheet is Frc1, frictional force between the sheet and the separation pad is Frc2, and frictional force between the sheets is Frc3, the sheet can be separated one sheet from other sheets by satisfying a relation of Frc1 >Frc2 >Frc3.

Japanese Patent Application Laid-Open No. 2001-19196 discusses a sheet feeding device, which provides a vibration damping member between a holding member, which holds a separation pad, and a pressure member, which presses the separation pad toward the feeding roller. Further, Japanese Patent No. 2533566 discusses a feeding device, which provides a vibration damping member between a separation pad and a holding member. When such sheet feeding devices are used, transmission of vibration that occurs when the separation pad contacts the sheet to the pressure member can be reduced. Thus, the occurrence of a noise caused by the vibration of the pressure member can be reduced.

The above-described Japanese Patent Application Laid-Open No. 2001-19196 and Japanese Patent No. 2533566, however, do not discuss the stability of the separation performance. The issues of the sheet feeding devices discussed in Japanese Patent Application Laid-Open No. 2001-19196 and Japanese Patent No. 2533566 will be described with reference to FIGS. 9A and 9B. FIG. 9A is a schematic diagram illustrating the configuration of the sheet feeding device according to Japanese Patent Application Laid-Open No. 2001-19196. FIG. 9B is a schematic diagram illustrating the configuration of the sheet feeding device according to Japanese Patent No. 2533566.

As illustrated in FIG. 9A, according to Japanese Patent Application Laid-Open No. 2001-19196, a vibration damping member 27 is arranged between a separation pad holding unit 26 and a separation pad pressure unit 25. The separation pad holding unit 26 holds a separation pad 24. The separation pad pressure unit 25 presses the separation pad 24 toward a feeding roller (not illustrated). As illustrated in FIG. 9B, according to Japanese Patent No. 2533566, the vibration damping member 27 is arranged between the separation pad 24 and the separation pad holding unit 26.

According to the above-described configurations, if thickness of the vibration damping member 27 in a direction of separation pressure is changed, action length of the separation pad pressure unit 25 will be changed, and pressure force of the separation pad pressure unit 25 will be changed. Thus, variations in the thickness of the vibration damping member 27 affect the separation pressure. Further, since the vibration damping member 27 is compressed and deformed by the pressure force applied by the separation pad pressure unit 25, the vibration damping member 27 itself has an elastic force and a viscous force in the direction of the separation pressure. Thus, variations in elastic coefficient and viscosity affect the separation pressure. If the separation pressure is changed, the separation performance of the sheet may be deteriorated.

As described above, according to the configurations discussed in Japanese Patent Application Laid-Open No. 2001-19196 and Japanese Patent No. 2533566, the separation performance may become instable since the variations in the thickness, the elastic coefficient, and the viscosity of the vibration damping member 27 may affect the separation pressure.

SUMMARY OF THE INVENTION

The present invention is directed to reducing a noise caused by the vibration of a pressure member without deteriorating the separation performance.

According to an aspect of the present invention, a sheet feeding device for feeding a sheet includes a feeding unit configured to feed sheets, a separation unit configured to separate the sheets fed by the feeding unit one by one, a holding unit configured to hold the separation unit, a pressure unit configured to press the holding unit toward the feeding unit while one side of the pressure unit contacts the holding unit, a fixing unit that contacts another side of the pressure unit, and a vibration damping unit attached to the pressure unit and configured to reduce vibration of the pressure unit, wherein the vibration damping unit is arranged at a position where the vibration damping unit does not contact both the holding unit and the fixing unit.

Further features of the present invention will become apparent from the following description of exemplary embodiments with reference to the attached drawings.

DESCRIPTION OF THE EMBODIMENTS

Figure 1A:
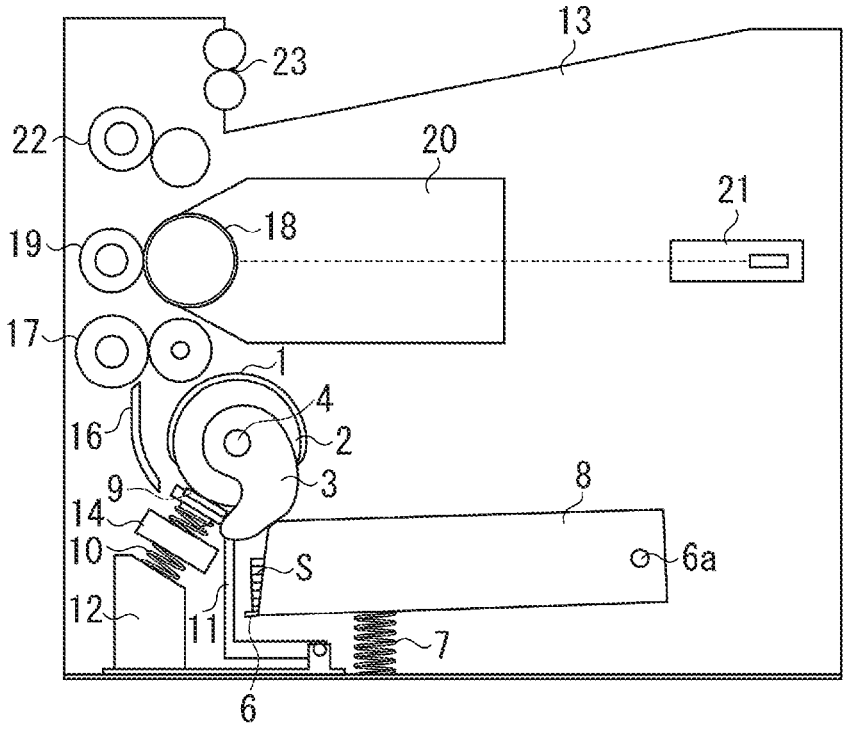
FIGS. 1A and 1B illustrate an overall configuration of an image forming apparatus according to a first exemplary embodiment and a perspective view of a sheet feeding device according to the first exemplary embodiment, respectively.
Figure 1B:
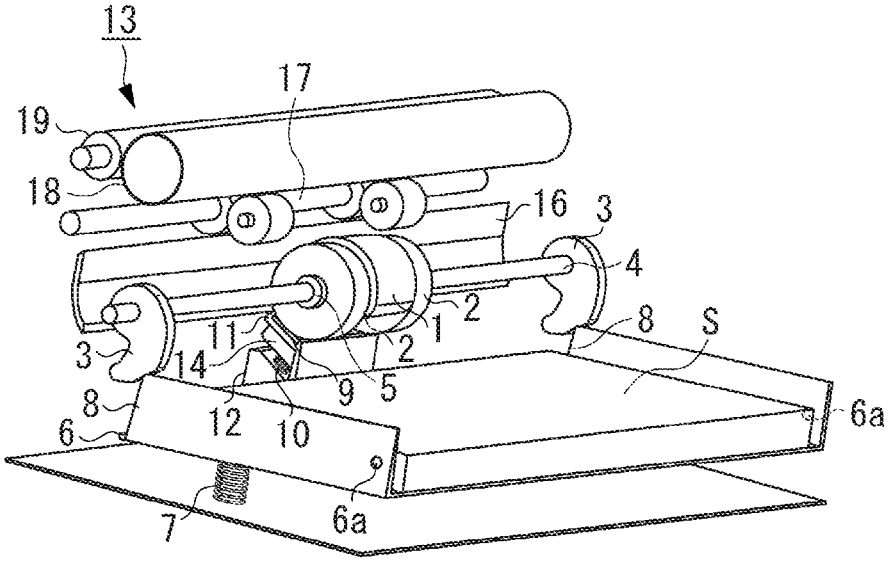

A first exemplary embodiment according to the present invention will be described with reference to FIGS. 1A and 1B to FIGS. 4A and 4B. FIG. 1A illustrates an overall configuration of an image forming apparatus according to the first exemplary embodiment. FIG. 1B is a perspective view of a sheet feeding device according to the first exemplary embodiment.

First, the configuration of the first exemplary embodiment will be described. A feeding roller 1 as a feeding unit feeds the sheet S stacked on a stacking plate 6. A feeding roller holder 5 is provided on a rotational axis 4 for holding the feeding roller 1, which rotates by driving of a drive unit (not illustrated), so that the feeding roller 1 rotates accompanying with the rotation of the rotational axis 4.

A feeding roller 2 is rotatably attached to both sides of the feeding roller 1. A feeding cam 3 is attached to the rotational axis 4 of the feeding roller 1. The feeding cam 3 rotates accompanying with the rotation of the rotational axis 4 of the feeding roller 1.

The stacking plate 6 can swing vertically around a stacking plate swing center 6*a*. A stacking plate pressure unit 7 presses the stacking plate 6 toward the feeding roller 1. A stacking plate cam 8, which contacts the feeding cam 3, is arranged on both sides of the stacking plate 6. The stacking plate 6 swings between a feeding position where the sheet stacked on the stacking plate 6 contacts the feeding roller 1 and a separation position where the sheet stacked on the stacking plate 6 is separated from the feeding roller 1 by linking with the rotation of the feeding cam 3.

The sheet S fed by the feeding roller 1 is separated one sheet from other sheets by frictional force of a separation pad 9 as a separation unit. The separation pad 9 is held by a separation pad holding unit 11 and fixed to an apparatus main body 13 via a separation pad fixing unit 12 in a swingable manner. The separation pad 9 is elastically pressed toward the feeding roller 1 by a compression coil spring 10 as a separation pad pressure unit. One side of the compression coil spring 10 is fixed to the separation pad fixing unit 12 and the other side is fixed to the separation pad holding unit 11. The apparatus main body 13 includes a cartridge 20, which is removable. The cartridge 20 includes a photosensitive drum 18 and a developing unit (not illustrated) in an integrated manner. A laser scanner 21 performs exposure corresponding to an image signal to form an electrostatic latent image on the photosensitive drum 18. The electrostatic latent image formed on the photosensitive drum 18 is developed by the developing unit to be visible as a toner image.

The sheet S, which is separated from other sheets and fed by the separation pad 9 and the feeding roller 1, is conveyed to a conveyance roller pair 17 along a conveyance guide 16. The toner image formed on the photosensitive drum 18 is transferred to the sheet S, which is conveyed by the conveyance roller pair 17, by a transfer roller 19. Then, the image is fixed to the sheet S by applying heat and pressure at a fixing unit 22. The sheet having the image fixed by the fixing unit 22 is discharged from the apparatus main body 13 by a discharge roller pair 23.

Figure 2A:
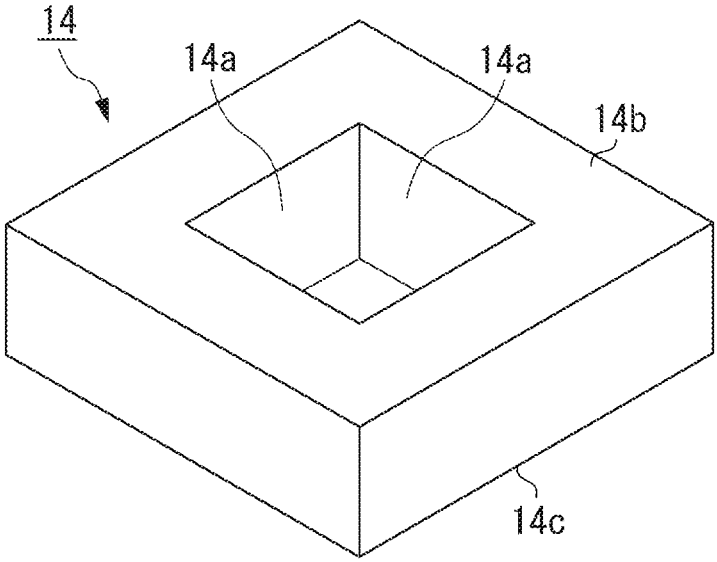
FIGS. 2A and 2B are a perspective view of a sponge member according to the first exemplary embodiment and a cross-sectional view of a separation unit according to the first exemplary embodiment, respectively.
Figure 2B:
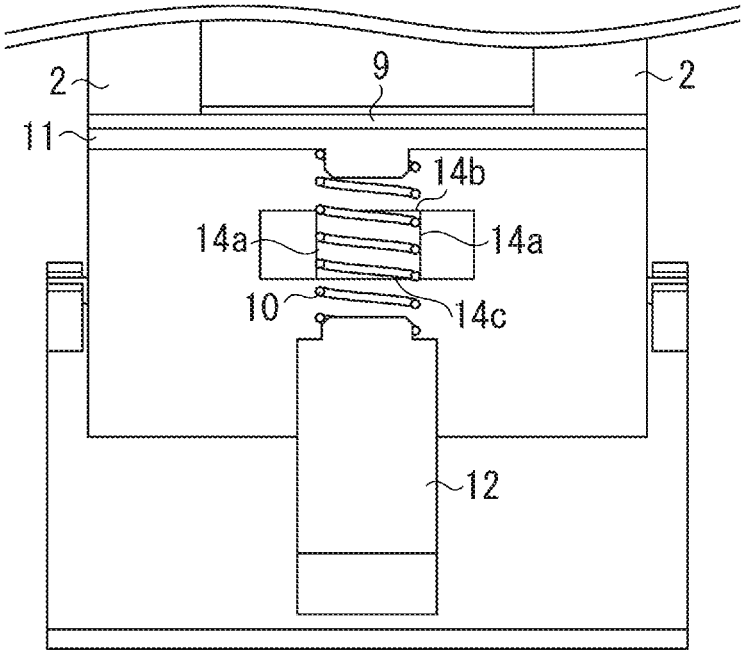

The sheet feeding device according to the present embodiment includes a sponge member 14 as a vibration damping unit, which is attached to the compression coil spring 10. The sponge member 14 reduces vibration of the compression coil spring 10 and reduces noise, which occur when the sheet is fed. The configuration of the sponge member 14 will be described in detail with reference to FIGS. 2A and 2B. FIG. 2A is a perspective view of the sponge member 14 according to the first exemplary embodiment. FIG. 2B is a cross-sectional view of the separation unit taken along the compression coil spring 10 according to the first exemplary embodiment.

When the sheet S to be fed is separated by the separation pad 9, the compression coil spring 10 is compressed for an amount corresponding to the thickness of the sheet S. When the sheet S passes the separation pad 9, the compression coil spring 10 returns from the compressed state by its pressing force.

As illustrated in FIG. 2A, the sponge member 14 is a cuboid shape having a hole at the center. The sponge member 14 includes an inner surface 14*a* of the hole, and a top surface 14*b* and a bottom surface 14*c*, which are substantially perpendicular to the inner surface 14*a*. As illustrated in FIG. 2B, the inner surface 14*a* of the sponge member 14 is attached to the outer periphery of the compression coil spring 10. The sponge member 14 is attached to the compression coil spring 10 in a state that the top surface 14*b* and the bottom surface 14*c* are substantially perpendicular to a pressing direction of the compression coil spring 10. Further, the sponge member 14 is arranged at the substantially middle portion of the compression coil spring 10 in the pressing direction so that the sponge member 14 does not contact the separation pad holding unit 11 and the separation pad fixing unit 12. According to the present embodiment, the sponge member 14 does not contact the separation pad holding unit 11 and the separation pad fixing unit 12 even if the sponge member 14 is compressed for an amount corresponding to the thickness of the sheet S when the sheet S is being fed. Further, since the sponge member 14 and the compression coil spring 10 are configured such that the inner hole width (the inner hole length) of the sponge member 14 is smaller than the diameter of the compression coil spring 10, the sponge member 14 does not fall by its own weight.

Figure 3:
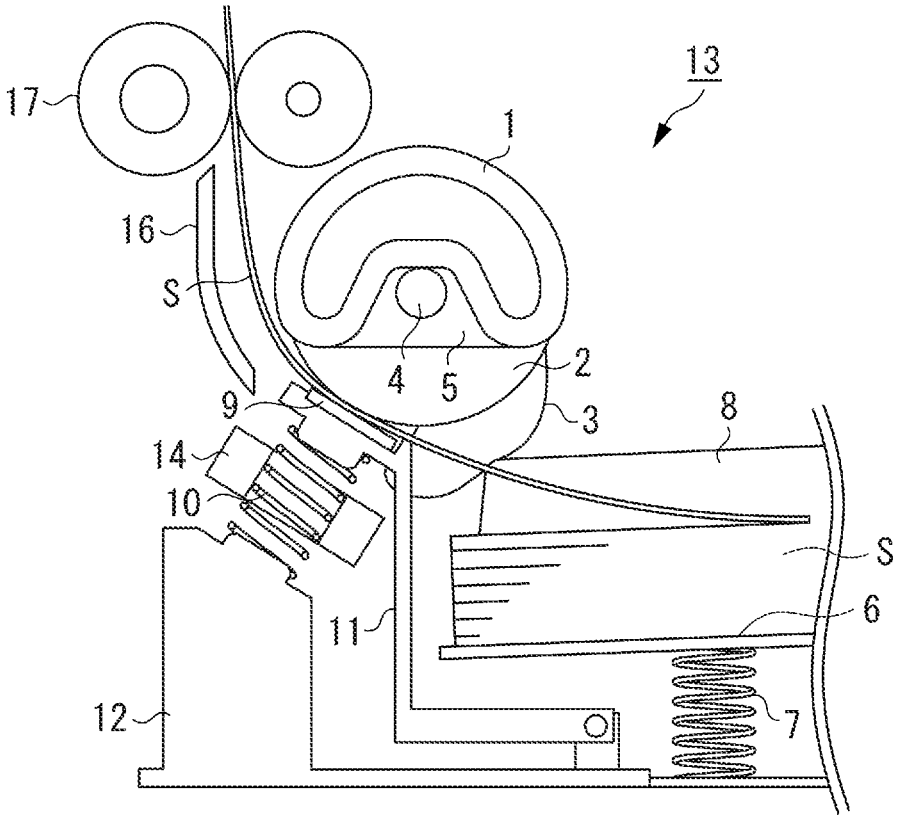
FIG. 3 is a cross-sectional view of the sheet feeding device in a state where a sheet is conveyed by a conveyance roller pair according to the first exemplary embodiment.
Figure 4A:
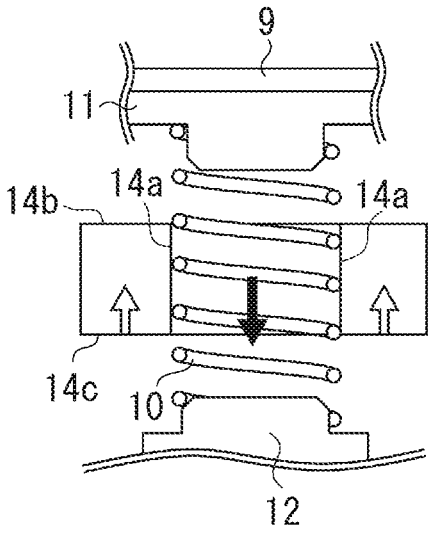
FIGS. 4A and 4B illustrate a vibration damping effect obtained by air resistance of a sponge member according to the first exemplary embodiment.
Figure 4B:
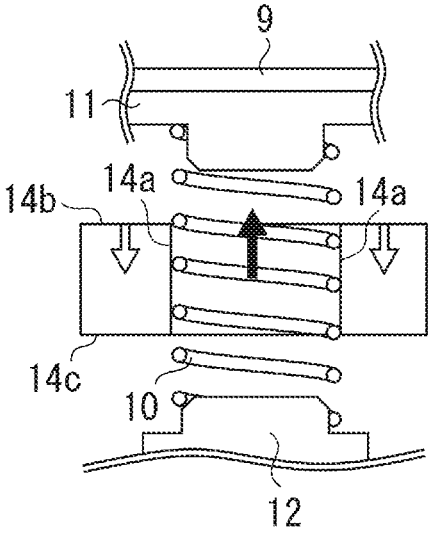

Next, the operation of the sheet feeding device according to the first exemplary embodiment will be described with reference to FIGS. 3, 4A, and 4B. FIG. 3 is a cross-sectional view of the sheet feeding device in a state where the sheet S is conveyed by the conveyance roller pair 17 according to the first exemplary embodiment. The cross-sectional view illustrated in FIG. 3 is taken along the feeding roller 1. FIGS. 4A and 4B illustrate the vibration damping effect obtained by air resistance of the sponge member 14 according to the first exemplary embodiment.

As illustrated in FIG. 3, when the sheet S which has been fed is conveyed by the conveyance roller pair 17, a portion of the sheet S contacts the separation pad 9. By the contact between the sheet S and the separation pad 9, a vibration (stick-slip phenomenon) occurs, and the vibration is transmitted to the compression coil spring 10. At this time, as illustrated in FIGS. 4A and 4B, the top surface 14*b* and the bottom surface 14*c* of the sponge member 14 receive air resistance in a direction opposite to a moving direction of the compression coil spring 10 that vibrates. Thus, the vibration of the compression coil spring 10 to which the sponge member 14 is attached is reduced.

As described above, even if the vibration that occurs when the sheet S contacts the separation pad 9 is transmitted to the compression coil spring 10, the occurrence of the noise caused by the vibration of the compression coil spring 10 can be reduced.

Further, since the sponge member 14 is attached to the outer periphery of the compression coil spring 10, the top surface 14*b* and the bottom surface 14*c* can be enlarged within the range in which the sponge member 14 does not cause interference with the peripheral components such as the separation pad holding unit 11. In this manner, the vibration damping effect obtained by the air resistance can be enhanced.

The sponge member 14 is arranged at the middle portion of the compression coil spring 10 in the pressing direction, and the top surface 14*b* and the bottom surface 14*c* do not contact the separation pad holding unit 11 and the separation pad fixing unit 12. According to this configuration, since action length of the compression coil spring 10 is not affected by the sponge member 14, the influence on the pressure force of the compression coil spring 10 will be small. Further, since an amount of compression and deformation of the sponge member 14 in the direction of the separation pressure is very small, the effect on elastic force and viscous force in the direction of the separation pressure of the sponge member 14 is also small. Thus, since the effect of the sponge member 14 on the separation pressure is small, the sponge member 14 does not affect the separation performance.

According to the first exemplary embodiment, although the sponge member 14 is arranged at the substantially middle portion of the compression coil spring 10 in the pressing direction, the present invention is not limited to the configuration.

The sheet feeding device according to a second exemplary embodiment will be described with reference to FIGS. 5A and 5B to FIG. 8. According to the second exemplary embodiment, descriptions of configurations and operations that are similar to those in the first exemplary embodiment are not repeated.

Figure 5A:
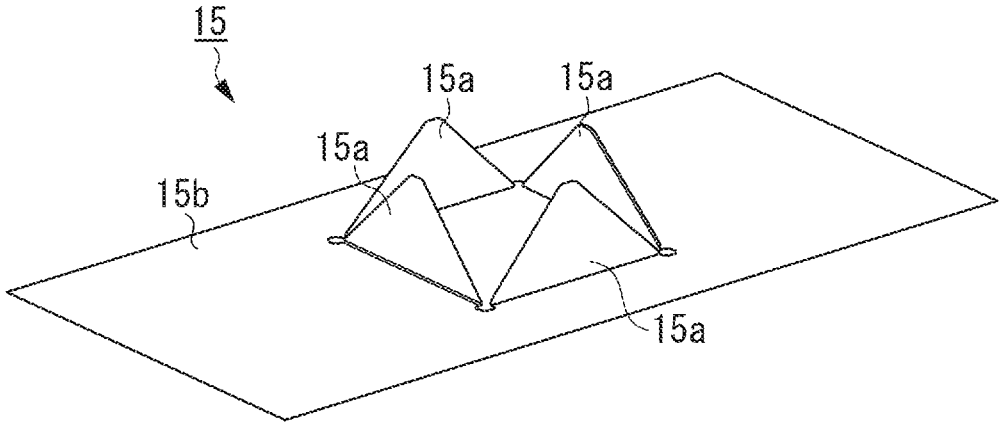
FIGS. 5A and 5B are a perspective view of a Mylar member according to a second exemplary embodiment and a cross-sectional view of the separation unit according to the second exemplary embodiment, respectively.
Figure 5B:
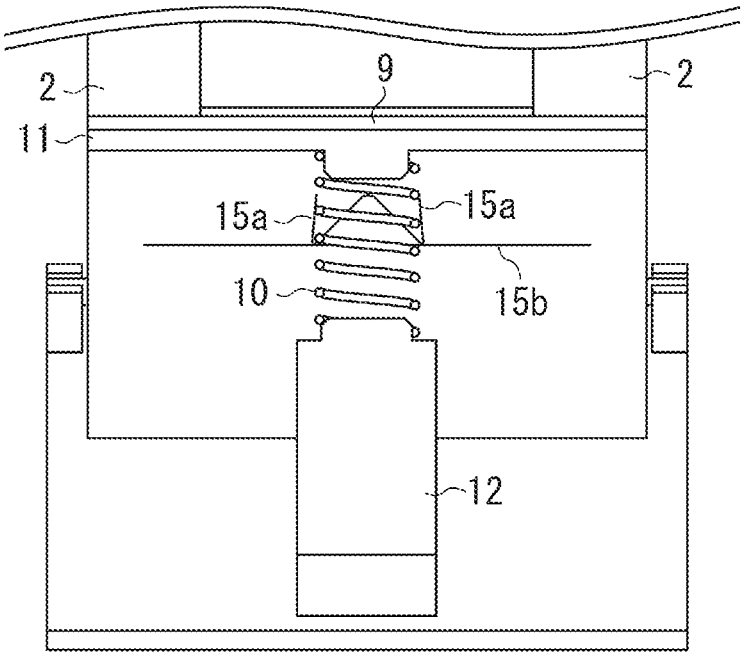

First, the configuration of the second exemplary embodiment will be described. The sheet feeding device according to the present exemplary embodiment includes a Mylar member 15 which is a flexible sheet. The Mylar member 15 serves as a vibration damping unit that is attached to a compression coil spring 10. The configuration of the Mylar member 15 will be described in detail with reference to FIGS. 5A and 5B. FIG. 5A is a perspective view of the Mylar member 15 according to the second exemplary embodiment. FIG. 5B is a cross-sectional view of a separation unit taken along the compression coil spring 10 according to the second exemplary embodiment.

As illustrated in FIG. 5A, the Mylar member 15 is a sheet having a flat portion 15*b* and a cut-and-fold portion 15*a*. The cut-and-fold portion 15*a* is formed by cutting and folding the center of the flat portion 15*b*. As illustrated in FIG. 5B, the cut-and-fold portion 15*a* of the Mylar member 15 is attached to the outer periphery of the compression coil spring 10. The Mylar member 15 is attached to the compression coil spring 10 in a state that the flat portion 15*b* is substantially perpendicular to the pressing direction of the compression coil spring 10. Further, the Mylar member 15 is arranged at the center of the compression coil spring 10 in the pressing direction so that the Mylar member 15 is configured not to contact a separation pad holding unit 11 and a separation pad fixing unit 12.

The returning force of the cut-and-fold portion 15*a* of the Mylar member 15 acts on the compression coil spring 10, the Mylar member 15 does not fall by its own weight.

Figure 6:
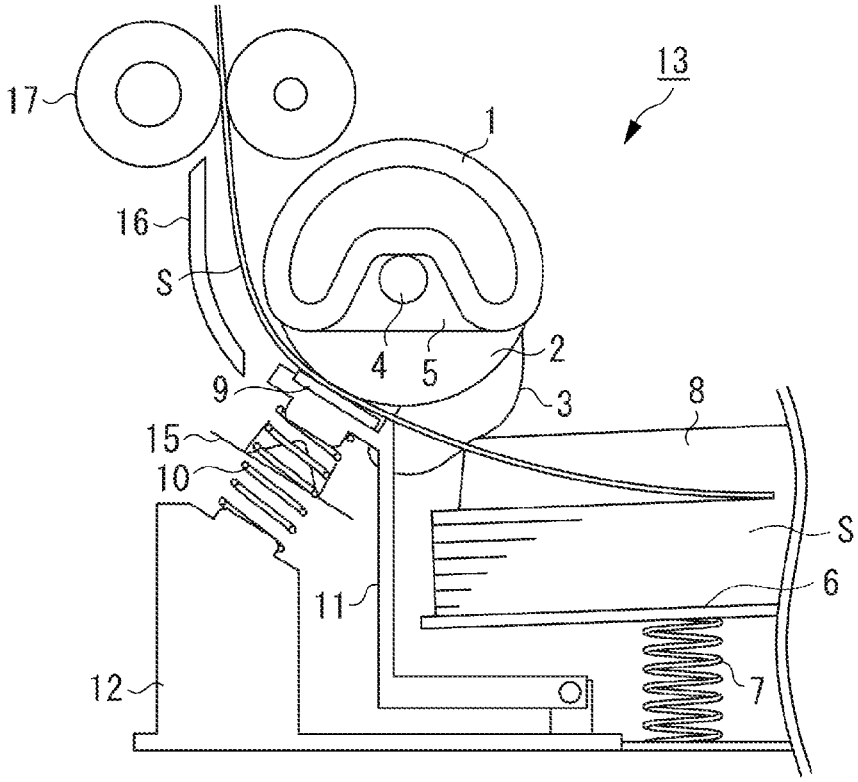
FIG. 6 is a cross-sectional view of the sheet feeding device in a state where a sheet is conveyed by the conveyance roller pair according to the second exemplary embodiment.
Figure 7A:
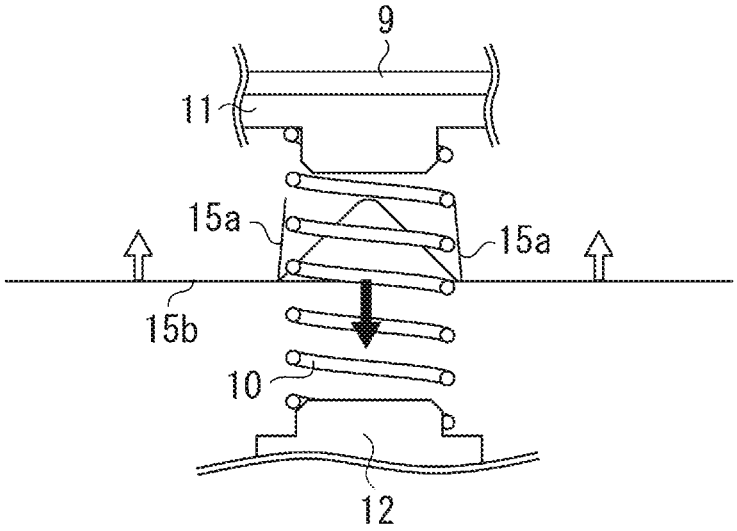
FIGS. 7A and 7B illustrate a vibration damping effect obtained by air resistance of the Mylar member according to the second exemplary embodiment.
Figure 7B:
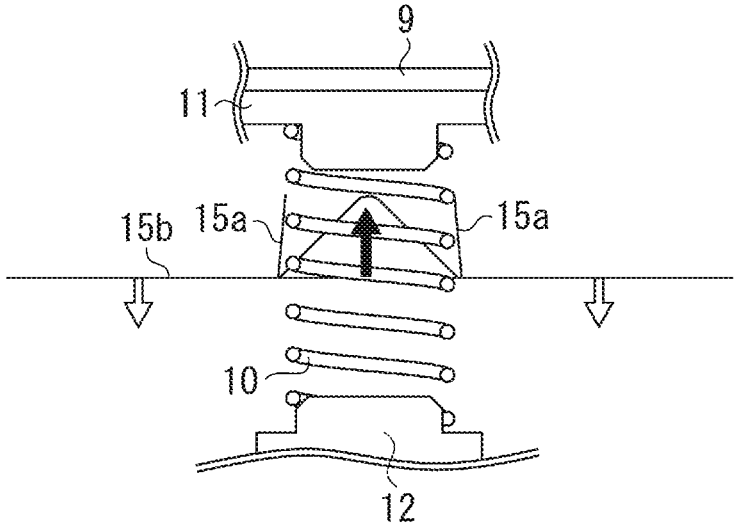
Figure 8:
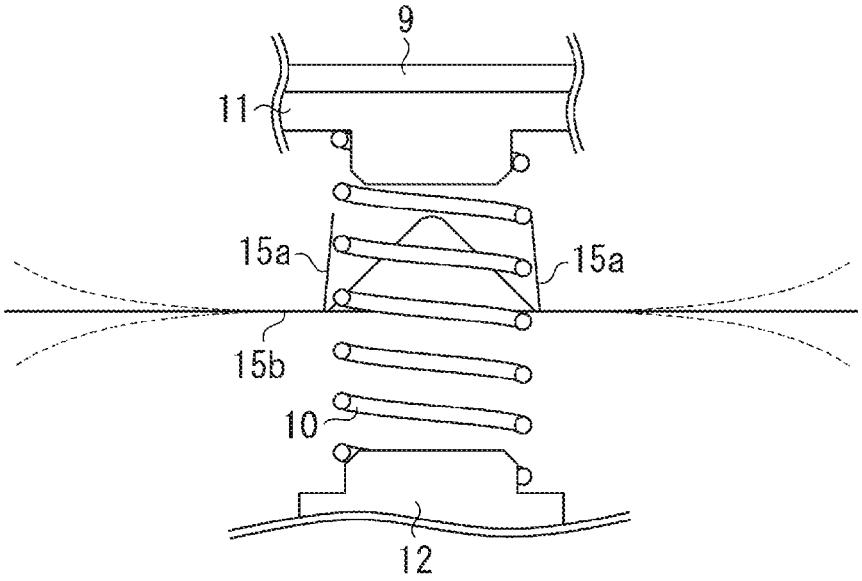
FIG. 8 illustrates the vibration damping effect produced by the Mylar member as a dynamic vibration absorber according to the second exemplary embodiment.
Figure 9A:
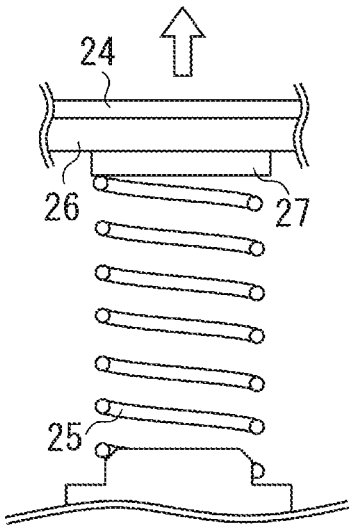
FIGS. 9A and 9B illustrate a conventional sheet feeding device, respectively.
Figure 9B:
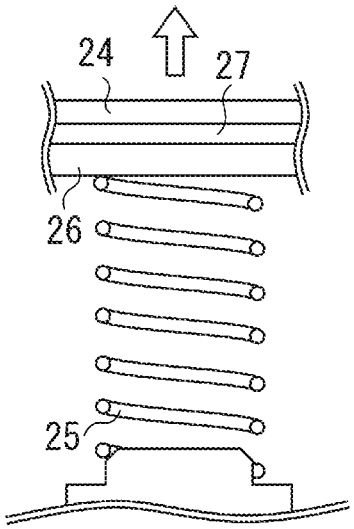

Next, the operation of the sheet feeding device according to the second exemplary embodiment will be described with reference to FIGS. 6 to 8. FIG. 6 is a cross-sectional view of the sheet feeding device in a state where the sheet S is conveyed by a conveyance roller pair 17 according to the second exemplary embodiment. The cross-sectional view illustrated in FIG. 6 is taken along the feeding roller 1. FIGS. 7A and 7B illustrate the vibration damping effect by air resistance of the Mylar member 15 according to the second exemplary embodiment. FIG. 8 illustrates the vibration damping effect obtained by the Mylar member 15 as a dynamic vibration absorber according to the second exemplary embodiment.

As illustrated in FIG. 6, when the sheet S is conveyed by the conveyance roller pair 17, a portion of the sheet S contacts a separation pad 9. By the contact between the sheet S and the separation pad 9, a vibration occurs, and the vibration is transmitted to the compression coil spring 10. At this time, as illustrated in FIGS. 7A and 7B, the flat portion 15*b* of the Mylar member 15 receives air resistance in the direction opposite to the moving direction of the compression coil spring 10 that vibrates. Thus, the vibration of the compression coil spring 10 to which the Mylar member 15 is attached is reduced. Further, since kinetic energy is consumed on deformation and vibration of the flat portion 15*b* as indicated by the broken lines in FIG. 8, the kinetic energy that is consumed on the vibration of the compression coil spring 10 will be reduced. The vibration of the compression coil spring 10 is also reduced by the effect of the Mylar member 15 as the dynamic vibration absorber.

As described above, even if the vibration that occurs when the sheet S contacts the separation pad 9 is transmitted to the compression coil spring 10, the occurrence of the noise caused by the vibration of the compression coil spring 10 can be reduced.

Further, since the Mylar member 15 is arranged to the outer periphery of the compression coil spring 10, the area of the flat portion 15*b* can be enlarged within the range that the Mylar member 15 does not cause interference with the peripheral components such as the separation pad holding unit 11. In this manner, the vibration damping effect obtained by the air resistance can be enhanced.

The Mylar member 15 is arranged at the substantially middle portion of the compression coil spring 10 in the pressing direction, and the flat portion 15*b* does not contact the separation pad holding unit 11 and the separation pad fixing unit 12. According to this configuration, since action length of the compression coil spring 10 is not affected by the Mylar member 15, the influence on the pressure force of the compression coil spring 10 will be small. Further, since the Mylar member 15 is not compressed and deformed in the direction of the separation pressure, the effect on elastic force in the direction of the separation pressure of the Mylar member 15 is also small. Thus, the effect of the Mylar member 15 on the separation pressure will be small.

According to the second exemplary embodiment, although the Mylar member 15 is arranged at the substantially middle portion of the compression coil spring 10 in the pressing direction, the present invention is not limited to the configuration.

According to the first and the second exemplary embodiments described above, although the separation pad 9 is used as the separation unit, the present invention is not limited to the configuration. For example, in place of the separation pad 9, a separation roller and a retard roller can be used. If a separation roller is used for a separation mechanism, the separation roller, which is supported on the rotation axis, is pressed to a feeding roller. The separation roller is driven to rotate counterclockwise around the rotation axis with receiving a predetermined load by a torque limiter.

According to the above-described exemplary embodiments, although an electrophotographic image forming apparatus is described as an example of the image forming unit, which forms an image on a sheet, the present invention is not limited to the electrophotographic image forming apparatus.

For example, the present invention can be applied to an image forming apparatus that forms an image on a sheet by an ink jet image forming process with which an image is formed on a sheet by ink discharged from a nozzle.

According to the present invention, a vibration damping unit attached to a pressure unit does not contact both a holding unit and a fixing unit. Thus, the noise caused by vibration of the pressure unit can be reduced without deteriorating a separation performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-003897 filed Jan. 11, 2013, which is hereby incorporated by reference herein in its entirety.

What is claimed is:

1. A sheet feeding device for feeding a sheet, the sheet feeding device comprising:

a feeding member configured to feed a sheet;

a separation member configured to separate sheets fed by the feeding member one by one;

a holding member configured to hold the separation member;

an elastic member configured to urge the holding member elastically against the feeding member while one side of the elastic member contacts the holding member;

a supporting member configured to contact another side of the elastic member and to support the elastic member; and an attached member attached to the elastic member, wherein the attached member includes a hole and the attached member is attached to the elastic member in a state that the elastic member passes through the hole.

2. The sheet feeding device according to claim 1, wherein the attached member is attached to an outer periphery of the elastic member.

3. The sheet feeding device according to claim 1, wherein the attached member is attached to a substantially middle portion of the elastic member in a pressing direction of the elastic member pressing the holding member to the feeding member.

4. The sheet feeding device according to claim 1, wherein the elastic member includes a compression coil spring.

5. The sheet feeding device according to claim 1, wherein the attached member includes a sponge member.

6. The sheet feeding device according to claim 1, wherein in a plane perpendicular to a pressing direction of the elastic member, a hole length of the hole is smaller than a diameter of the elastic member.

7. The sheet feeding device according to claim 1, wherein the attached member includes a top surface and a bottom surface, and wherein a vibration of the elastic member is reduced by air resistance of the top surface and the bottom surface.

8. The sheet feeding device according to claim 1, wherein the attached member includes a polyester film member having a surface substantially perpendicular to a pressing direction of the elastic member.

9. The sheet feeding device according to claim 1, wherein the attached member is arranged at a position where the attached member does not contact the holding member.

10. The sheet feeding device according to claim 9, wherein the attached member is arranged at a position where the attached member does not contact both the holding member and the fixing member.

11. The sheet feeding device according to claim 1, wherein the attached member is configured to reduce vibration of the elastic member.

12. A sheet feeding device comprising:

a feeding member configured to feed a sheet;

a separation member configured to separate sheets fed by the feeding member one by one;

a holding member configured to hold the separation member;

an elastic member configured to urge the holding member elastically against the feeding member while one side of the elastic member contacts the holding member;

a supporting member configured to contact another side of the elastic member and to support the elastic member; and a sponge member attached to the elastic member.

13. The sheet feeding device according to claim 12, wherein the sponge member is arranged at a position where the attached member does not contact the holding member.

14. A sheet feeding device comprising:

a feeding member configured to feed a sheet;

a separation member configured to separate sheets fed by the feeding member one by one;

a holding member configured to hold the separation member;

an elastic member configured to press the holding member elastically toward the feeding member while one side of the elastic member contacts the holding member;

a supporting member configured to contact another side of the elastic member and to support the elastic member; and an attached member fixed to the elastic member directly, wherein the attached member is supported by the elastic member.

15. The sheet feeding device according to claim 14, wherein the attached member is arranged at a position where the attached member does not contact the holding member.

16. The sheet feeding device according to claim 15, wherein the attached member is arranged at a position where the attached member does not contact both the holding member and the supporting member.

17. The sheet feeding device according to claim 14, wherein the attached member is configured to reduce vibration of the elastic member.

18. The sheet feeding device according to claim 14, wherein the attached member is attached to a substantially middle portion of the elastic member in a urging direction of the elastic member urging the holding member to the feeding member.

* * * * *